US007258258B1

(12) United States Patent
Schweizer

(10) Patent No.: US 7,258,258 B1
(45) Date of Patent: Aug. 21, 2007

(54) CLOTHES HANGER

(76) Inventor: Paul Schweizer, Hönggerstrasse 16, CH-8103 Unterengstringen (CH)

( * ) Notice: Subject to any disclaimer, the term of this patent is extended or adjusted under 35 U.S.C. 154(b) by 0 days.

(21) Appl. No.: 09/936,275

(22) PCT Filed: Feb. 29, 2000

(86) PCT No.: PCT/CH00/00112

§ 371 (c)(1),
(2), (4) Date: Dec. 21, 2001

(87) PCT Pub. No.: WO00/53066

PCT Pub. Date: Sep. 14, 2000

(30) Foreign Application Priority Data

Mar. 11, 1999 (CH) ..... 0459/99

(51) Int. Cl.
*A41D 27/22* (2006.01)

(52) U.S. Cl. ..... 223/92; 223/85

(58) Field of Classification Search ..... 223/92, 223/85

See application file for complete search history.

(56) References Cited

U.S. PATENT DOCUMENTS

| | | | | | |
|---|---|---|---|---|---|
| 318,790 | A | * | 5/1885 | Patton | 285/181 |
| 2,376,269 | A | * | 5/1945 | Pauli | 223/88 |
| 2,656,955 | A | * | 10/1953 | Harrell | 223/98 |
| 4,593,839 | A | | 6/1986 | Vandoros | |
| 5,022,570 | A | * | 6/1991 | Watford | 223/94 |
| 5,269,242 | A | * | 12/1993 | Toldi | 119/52.2 |
| 5,417,352 | A | * | 5/1995 | Jen | 223/85 |
| 5,423,291 | A | * | 6/1995 | Daugherty | 119/77 |
| 5,881,675 | A | * | 3/1999 | Shaffer | 119/430 |

FOREIGN PATENT DOCUMENTS

| | | |
|---|---|---|
| FR | 2 719 207 A3 | 11/1995 |
| FR | 2 779 630 A1 | 12/1999 |

* cited by examiner

*Primary Examiner*—Gary L. Welch
*Assistant Examiner*—Nathan Durham
(74) *Attorney, Agent, or Firm*—The Webb Law Firm

(57) ABSTRACT

A clothes hanger is provided with a hook and two arms projecting from it. Each of the arms is formed by a bottle-shaped container. The hook preferably has a thread for each bottle-shaped container. Each of the bottle-shaped containers is detachably screwed into one of these threads by means of its mouth.

20 Claims, 2 Drawing Sheets

CLOTHES HANGER

BACKGROUND OF THE INVENTION

1. Field of the Invention

This invention relates to a clothes hanger with a hook and two arms projecting from it.

FR-A-2 719 207 describes a clothes hanger with a hook and two arms projecting from it.

2. Description of the Related Art

The object of the invention is to create a clothes hanger that preserves the shape of the articles of clothing hung on it and can nevertheless be manufactured very economically.

SUMMARY OF THE INVENTION

The invention teaches that this object can be accomplished by a clothes hanger of the type described above in which each of the arms is formed by a bottle-shaped container. Beverage bottles, among other things, have an essentially cylindrical shape with rounded edges and are extremely well-suited as supports for clothes. The drinking bottles provide a seamless and very protective support for articles of clothing. Used plastic beverage bottles are particularly well suited for use as the bottle-shaped containers. These bottles are very lightweight and yet retain their shape very well. The clothes hanger claimed by the invention is therefore particularly well suited for the recycling of used beverage bottles. The used beverage bottles simply need to be cleaned, which means that the recycling process consumes very little energy.

In one development of the invention, each of the bottle-shaped containers is fastened by means of its mouth to the hook. A fastening of this type is particularly simple and stable if the hook has a thread for each bottle-shaped container and each of the bottle-shaped containers is screwed into one of these threads by means of its mouth. The bottle-shaped containers can then be fastened to the hook and removed from it very easily. The hook need only be provided with two threads. Because threads of this type are standard on beverage bottles, a great many different types of beverage bottles can be used.

The hook can be manufactured very economically in the form of an injection molded plastic part. Other materials can also be used, however, such as iron, wood and similar materials. The hook can also be provided with a wire loop.

Clothes hangers as taught by the invention are also well suited for use as advertising media.

The invention also relates to a hook for a clothes hanger. This hook is characterized by two fastening means that are provided for the fastening of two bottle-shaped containers. Because beverage bottles can be found in almost every household, the manufacture of the clothes hanger can be limited to the manufacture of the hook. The arms are then manufactured by the user, by fastening his or her own beverage bottles. The user can replace these arms with other bottle-shaped containers as necessary. Hangers of different sizes can be created by using different sizes of bottles. For transport, the size of the hanger can be reduced by removing the bottles.

DETAILED DESCRIPTION OF THE PREFERRED EMBODIMENT

Figure 1:
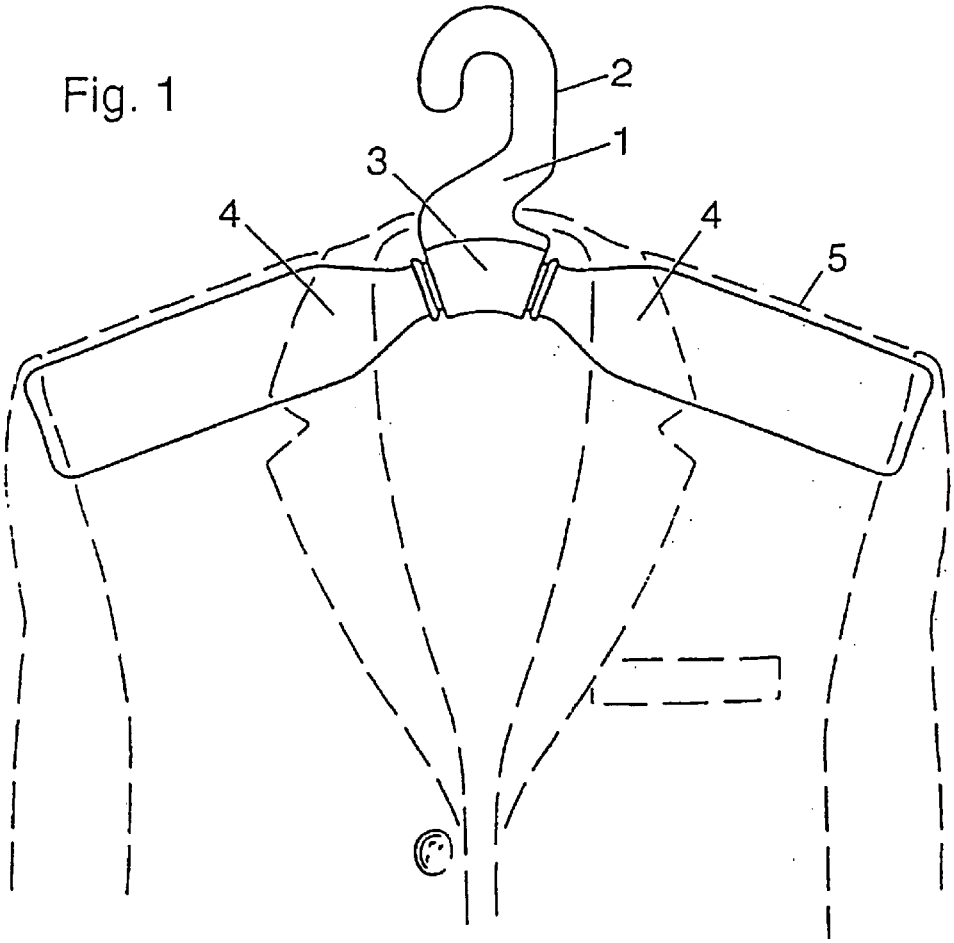
FIG. 1 is a view of a clothes hanger as claimed by the invention with an article of clothing indicated in broken lines.

FIG. 1 shows a jacket 5 which is hung on a clothes hanger 1. This clothes hanger 1 consists essentially of a hook 2 and two bottle-shaped containers 4 which are fastened to said hook.

Figure 3:
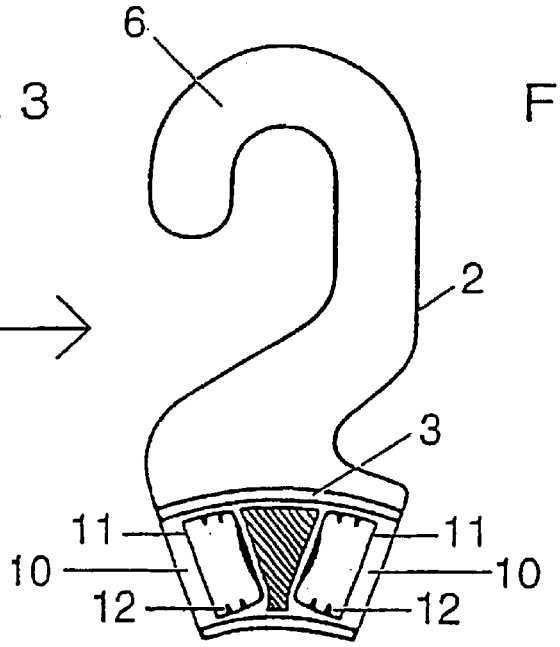
FIG. 3 is a view of a hook in partial cross section.
Figure 4:
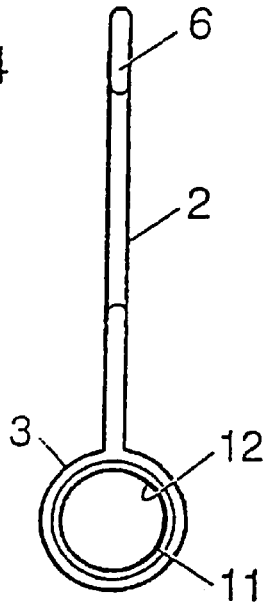
FIG. 4 is a view of the hook in the direction indicated by Arrow IV in FIG. 3.
Figure 5:
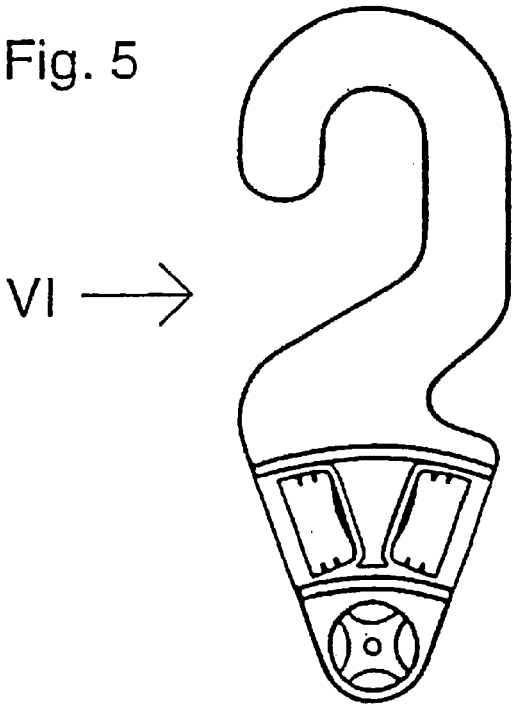
FIG. 5 is a view of a further embodiment of a hook in partial cross-section.
Figure 6:
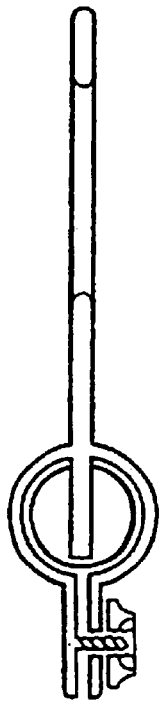
FIG. 6 is a view of the hook in a direction indicated by Arrow VI in FIG. 5.

To fasten the bottle-shaped containers to the hook 2, the hook 2, as shown in FIG. 3, has two threads 12 which are formed by threaded caps 11, each of which is inserted into a recess 10 of a fastening part 3 of the hook. The covers 11 are fastened in the recesses 10 in a suitable manner such as by locking, latching and/or by means of a suitable adhesive or by welding. The thread 12 can also be formed directly on the fastening part 3, however. The hook 2 can be a single-story injection molded part, for example.

Figure 2:
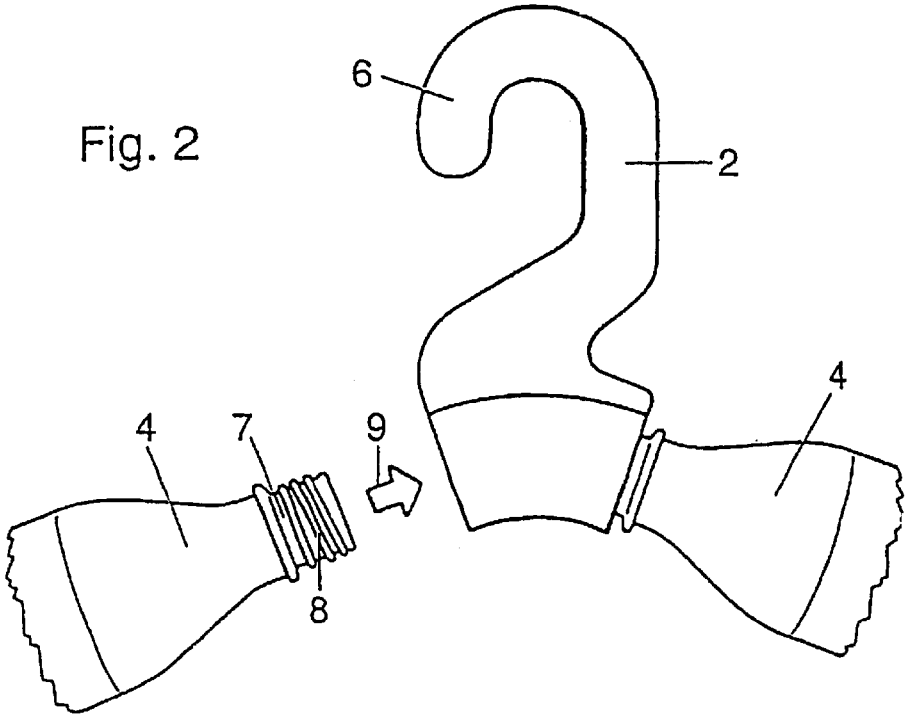
FIG. 2 is a schematic illustration of the fastening of a beverage bottle to a hook

Each of the bottle-shaped containers 4 is screwed by means of a thread 8 on its mouth in the direction indicated by the arrow 9 onto one of the two threads 12 as illustrated in FIG. 2. The threads 12 are opposite each other and are oriented so that the two bottle-shaped containers 4 fastened to the hook 2 are at an appropriate angle to each other, which angle is preferably greater than 90 degrees. The fastening of the bottle-shaped containers 4 to the hook 2 is preferably although not necessarily detachable. The threaded connection shown here can also be replaced by other suitable connections, such as snap connections or locking connections.

The hook 2 is preferably made of plastic using the injection molding process. The curve 6 of the hook 2, however, can also be a curve made of wire or a similar material. It is also conceivable that the hook can be made of wood or another suitable material.

What is claimed is:

1. A hook for a hanger, comprising a fastening part including a pair of recesses positioned therein, wherein the recesses include threads therein, wherein the hook extends along a vertical axis, thereby defining a horizontal axis disposed at a 90 degree angle therefrom and wherein the recesses extend at an angle divergent from the horizontal axis and the threads are configured to receive corresponding threads on a beverage bottle container.

2. The hook of claim 1, wherein the threads of the recess are formed directly on an interior portion of the recess of the fastening part.

3. The hook of claim 1, wherein the threads of the recess are formed by threads of a cap of a beverage bottle container fastened within the recess.

4. The hook of claim 3, wherein the cap is fastened within the recess by locking the cap within the recess.

5. The hook of claim 3, wherein the cap is fastened within the recess by latching the cap within the recess.

6. The hook of claim 3, wherein the cap is fastened within the recess by adhering the cap within the recess.

7. The hook of claim 3, wherein the cap is fastened within the recess by welding the cap in the recess.

8. The hook of claim 1, further comprising a beverage bottle container detachably fastened to the fastening part of the hook.

9. The hook of claim 8, wherein the beverage bottle container is plastic.

10. The hook of claim 1, wherein the fastening part is located on a lower end of the hook.

11. The hook of claim 1, wherein the hook is manufactured in the form of a plastic injection molded part.

12. The hook of claim 1, wherein at least a portion of the hook is manufactured from at least one of wood and wire.

13. A clothes hanger, comprising a hook and two arms projecting from the hook, wherein the arms are each formed by a beverage bottle container having a threaded mouth, the hook extending along a vertical axis, thereby defining a horizontal axis disposed 90 degrees therefrom, and the hook comprising a fastening part including a pair of recesses positioned therein, wherein each of the recesses include threads therein, wherein the recesses extend at an angle divergent from the horizontal axis and the threads are configured to receive the threaded mouth of the beverage bottle container.

14. The hook of claim 13, wherein the threads of the recess are formed directly on an interior portion of the recess of the fastening part.

15. The hook of claim 13, wherein the threads of the recess are formed by threads of a cap of a beverage bottle container fastened within the recess.

16. The hook of claim 15, wherein the cap is fastened within the recess by at least one of (i) locking the cap within the recess; (ii) latching the cap within the recess; (iii) adhering the cap within the recess; and (iv) welding the cap in the recess.

17. The hook of claim 13, wherein the beverage bottle container is detachably fastened to the fastening part of the hook.

18. The hook of claim 13, wherein the beverage bottle containers are plastic.

19. The hook of claim 13, wherein the hook is manufactured in the form of a plastic injection molded part.

20. The hook of claim 13, wherein at least a portion of the hook is manufactured from at least one of wood and wire.

* * * * *

UNITED STATES PATENT AND TRADEMARK OFFICE

CERTIFICATE OF CORRECTION

PATENT NO. : 7,258,258 B1
APPLICATION NO. : 09/936275
DATED : August 21, 2007
INVENTOR(S) : Schweizer It is certified that error appears in the above-identified patent and that said Letters Patent is hereby corrected as shown below:

Column 1, after Line 7, before the paragraph that begins "FR-A-2 719 207" insert the following heading: -- 2. Description of the Relate Art --

Column 1, after Line 10, before the paragraph that begins "The object of the invention" insert the following heading: -- SUMMARY OF THE INVENTION --.

Column 1, Line 11, delete the heading "2. Description of the Related Art"

Column 1, Line 17, delete the heading "SUMMARY OF THE INVENTION"

Signed and Sealed this

Twenty-third Day of September, 2008

JON W. DUDAS
*Director of the United States Patent and Trademark Office*

UNITED STATES PATENT AND TRADEMARK OFFICE

CERTIFICATE OF CORRECTION

PATENT NO. : 7,258,258 B1
APPLICATION NO. : 09/936275
DATED : August 21, 2007
INVENTOR(S) : Schweizer It is certified that error appears in the above-identified patent and that said Letters Patent is hereby corrected as shown below:

Column 1, after Line 7, before the paragraph that begins "FR-A-2 719 207" insert the following heading: -- 2. Description of the Related Art --

Column 1, after Line 10, before the paragraph that begins "The object of the invention" insert the following heading: -- SUMMARY OF THE INVENTION --

Column 1, Line 11, delete the heading "2. Description of the Related Art"

Column 1, Line 17, delete the heading "SUMMARY OF THE INVENTION"

This certificate supersedes the Certificate of Correction issued September 23, 2008.

Signed and Sealed this

Eighteenth Day of November, 2008

JON W. DUDAS
*Director of the United States Patent and Trademark Office*